United States Patent [19]

Heighway

[11] 3,967,225

[45] June 29, 1976

[54] MAGNETIC BEAM DEFLECTOR SYSTEM

[75] Inventor: Edward A. Heighway, Deep River, Canada

[73] Assignee: Atomic Energy of Canada Limited, Ottawa, Canada

[22] Filed: Mar. 3, 1975

[21] Appl. No.: 554,563

[30] Foreign Application Priority Data

Aug. 15, 1974 Canada ..... 207147

[52] U.S. Cl. ..... 335/210; 313/361

[51] Int. Cl.[2] ..... H01F 7/00

[58] Field of Search ..... 335/210; 313/361; 328/227; 250/298

[56] References Cited

UNITED STATES PATENTS

| | | | |
|---|---|---|---|
| 3,691,374 | 9/1972 | Leboutet | 335/210 |
| 3,867,635 | 2/1975 | Brown et al. | 335/210 |

*Primary Examiner*—Harold Broome

*Attorney, Agent, or Firm*—Edward Rymek

[57] ABSTRACT

The magnetic beam deflector system of this invention consists of two identical mirror image sections positioned about a symmetry plane. The sections are energized such that the zeroth order beam path through one section is a mirror image of the beam path through the other section resulting in a beam exit axis which is symmetrically located on one side of the symmetry plane with respect to the entry axis on the other side. In a 180° deflector system, the entry and exit axes are coincident and lie in the symmetry plane. The preferred embodiment consists of four dipole magnets, forming a 180° deflector system symmetrical about a symmetry plane in which the zeroth order beam path is defined by:

$$\theta_2 = \theta_1 + \theta_3 + 90° \text{ and}$$

$$d_2 = \frac{d_1 \sin\theta_1 + \rho_1(1-\cos\theta_1) - \rho_3\{\sin\theta_3\} - \rho_2(\cos\theta_1 + \sin\theta_3)}{\cos\theta_3}$$

where $\theta_1$, $\theta_2$ and $\theta_3$ are the bending angles of the first, second and fourth, and third magnets respectively, $\rho_1$, $\rho_2$ and $\rho_3$ are the bending radii of the first, second and fourth, and third magnets respectively, and $d_1$ and $d_2$ are the distances between the first - second, first - fourth, magnets and second - third, third - fourth magnets respectively.

The system is further adjusted to be non-focussing achromatic and isochronous.

6 Claims, 4 Drawing Figures

MAGNETIC BEAM DEFLECTOR SYSTEM

This invention is directed to a beam deflector system for charged particles and in particular to a magnetic system which is achromatic and isochronous for deflecting a beam of charged particles through 180°.

In recent years, electron accelerators have been supplanting conventional 60C° units for radiation therapy with increasing frequency since the photon bremsstrahlung radiation is more penetrating; electron beam radiation treatment is also possible; the radiation intensity and field can be higher, more defined and does not decay, and there is relatively little or no radiation hazard when the machine is off.

Such an accelerator may consist of a linear accelerator having an accelerating section made up of a number of resonant cavities. The accelerating section is excited by a microwave source such that a standing wave in the $\pi/2$ mode is established. A beam of charged particles is injected into one end of the accelerating section accelerated as it moves through the section, reversed in direction when it exits and reinjected into the accelerating section to be further accelerated as it moves through the accelerating section in the reversed direction.

The accelerating fields in the resonant cavities vary sinusoidally and the emergent beam consists of discrete spatially separated bunches of particles occupying time intervals corresponding to a small portion of the period of the cyclic field. The bunch contains particles with a finite range of energies, displacements from the central axis and directions non-parallel to the axis. If such a bunch is reinjected into the accelerating section it must do so at the correct time interval in the cyclic field and the bunch length must have been essentially unchanged by the reflection process. If this is not the case and the bunch length is longer, some particles will receive accelerations far from the means acceleration and a resultant large momentum spread will be introduced into the beam. This is an undesirable result and the reflecting system must therefore not significantly increase the bunch length of the beam. To achieve this the reflecting system has to be isochronous - that is all particles, independent of their momentum, position or direction have to take the same time to traverse the reflecting system.

Further, the beam size and divergence after reflection must not be altered in order that the beam may be reinjected without losses into the accelerating section. This requires that the overall system must be non-focussing and achromatic. To be achromatic means that all particles initially travelling on coincident paths but with different energies must reemerge from the reflecting system on coincident paths.

Various systems exist wherein a beam is deflected by 180°, some of which actually bend the beam through two 270° bends in the two stages or a 180°bend. However, these systems have been found wanting as not being either achromatic, isochronous or non-focussing.

It is therefore, an object of this invention to provide a magnetic deflector system which will deflect a beam of particles through predetermined angle while maintaining approximately identical beam size at the entry and exit of the system.

It is a further object of this invention to provide a magnetic deflector system in which beam particles which are coincident on entry into the system, will be coincident on exit from the system.

It is yet another object of this invention to provide a 180° beam deflector system in which the deflected beam follows a path coincident with the entry beam axis.

It is another object of this invention to provide a 180° beam deflector system in which particles off axis but parallel to the entry axis will return to their entry axis but reversed in direction.

It is a further object of this invention to provide a 180° beam deflector system in which particles on the entry axis but travelling at a small angle of inclination to the axis will return to an equally inclined exit axis but reflected about the entry axis.

It is yet another object of this invention to provide a 180° deflector system in which particles on the entry axis but of different momentum than the means momentum will return to and travel along the entry axis.

It is a further object of this invention to provide a 180° deflector system in which particles on the entry axis but of different momentum than the mean beam momentum will take the same time to traverse their respective paths to the entry point.

It is yet another object of this invention to provide a 180° deflector system in which particles displaced out of the plane of the bend but of the mean momentum will return along their entry axis.

It is a further object of this invention to provide a 180° deflector system in which particles displaced in direction out of the plane of the bend will return along their entry axis.

These and other objects have been achieved in a magnetic deflector system which is symmetrical in construction about a symmetry plane. The system includes identical magnet means symmetrically located across the symmetry plane with entry and exit axes to the system also being symmetrically located with respect to the symmetry plane. The two halves of the magnet system are energized in an identical manner to deflect a zeroth order beam along mirror image paths through the magnet means.

In addition, for beam particles which are displaced from the entry axis, the particles are deflected to cross the symmetry plane at a focus point thereon or perpendicular thereto.

For beam particles which are of differing momenta and relativistic velocity, the particles are deflected to cross the symmetry plane perpendicular thereto as well as pass through momentum focus points symmetrically located about the symmetry plane.

For beam particles which are of differing momenta and of non-relativistic velocity, the particles are deflected to cross the symmetry plane perpendicular thereto with path lengths such that the particle path lengths divided by the particular particle velocity will be equal.

Alternatively, particles of differing momenta may be deflected to cross the symmetry plane at a momentum focus point thereon with path lengths such that all particles traverse the system is equaL time.

Figure 1:
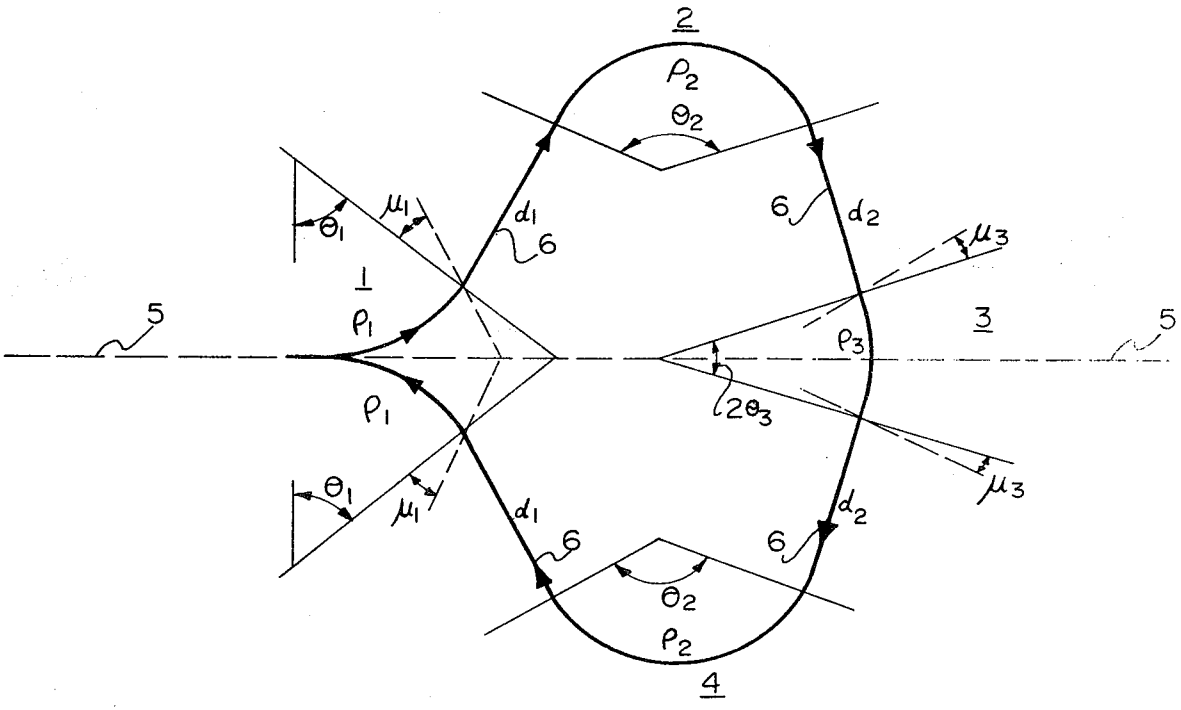
FIG. 1 illustrates generally a four magnet 180° deflector system.

FIG. 1 generally illustrates in schematic form a 180° magnetic deflector system. It consists of four magnet means 1, 2, 3 and 4 located symmetrically about a symmetry plane through axis 5. When used in conjunction with a linear accelerator, axis 5 is the axis of the accelerator. Magnets 2 and 4 are identical and so located with respect to magnets 1 and 3 that the system below axis 5 is a mirror image of the system above axis 5. $\theta_1$, $\theta_2$ and $\theta_3$ represent the bending angles of the beam 6 and $\rho_1$, $\rho_2$ and $\rho_3$ represent the bending radii of the beam in each magnet means within the faces of 1–2, 1–4 and 2–3, 3–4 respectively. Finally $\mu_1$ and $\mu_3$ represent pole face rotations for magnets 1 and 3 respectively. The bending radii and angles in the system are free parameters bounded by two criteria to define the zeroth order beam path 6:

$$\theta_2 = \theta_1 + \theta_3 + 90° \text{ and}$$

$$d_2 = \frac{\{d_1 \sin\theta_1 + \rho_1(1-\cos\theta_1) - \rho_3|\sin\theta_3| - \rho_2(\cos\theta_1 + \sin\theta_3)\}}{\cos\theta_3}$$

The axial focussing at the pole edges uses the formulation $$f = \tan(\mu - \psi)/\rho$$

where f is the effective axial focal length, $\mu$ the pole face rotation angle and $\rho$ the dipole magnet bending radius. $\psi$ is a correction term to include the effects of extended pole edge fringing fields.

The symmetry required for axial focussing is achieved by making use of the pole face rotations in the first and third magnets as shown in FIG. 1, to ensure that axially displaced entrant particles cross the symmetry plane perpendicular thereto. This could also be achieved by deflecting these particles to a focus point on the symmetry plane, but larger pole face rotation angles would then be required.

Figure 2:
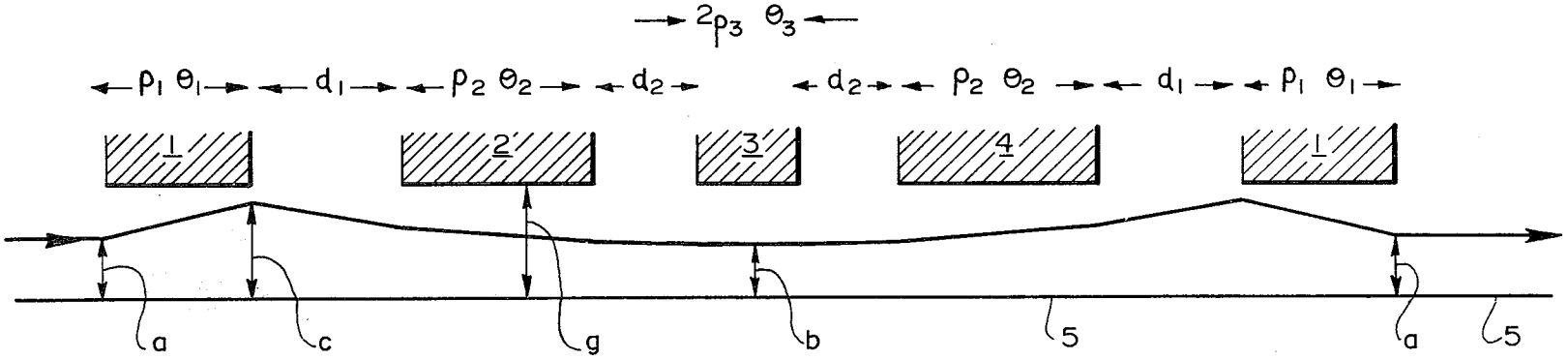
FIG. 2 illustrates the axial beam profile of the magnetic deflector system in FIG. 1.

The perpendicular crossing of the symmetry plane is seen in FIG. 2 and shows an unfolded view of the magnet means 1, 2, 3 and 4 with axis 5 centrally located between the pole faces of the magnets and 6 representing the beam path. a is the paraxial displacement of the entrant and exit beam, *b* is the paraxial displacement of the beam at mid-point under magnet 3, *c* is the paraxial displacement of the beam at first exit edge and the reentrant edge of magnet 1, and *g* is the paraxial displacement of the magnet faces. It is desirable to have *b* close to a and not significantly greater than a to keep the pole gap small. Defocussing of the beam occurs at all magnet edges due to the effect of fringing fields. At the exit edge of magnet 1, the pole face rotation $\mu_1$ has a focussing effect on the beam. The pole face rotation on the third magnet is defined by the requirement that it deflect the beam at that point to make it parallel to the axial plane, while that of the first magnet is a free parameter. The system is thus defined by the free parameters $\rho_1$, $\theta_1$, $\rho_2$, $\theta_2$ , $\mu_1$, $\rho_3$ and $d_1$.

Figure 3:
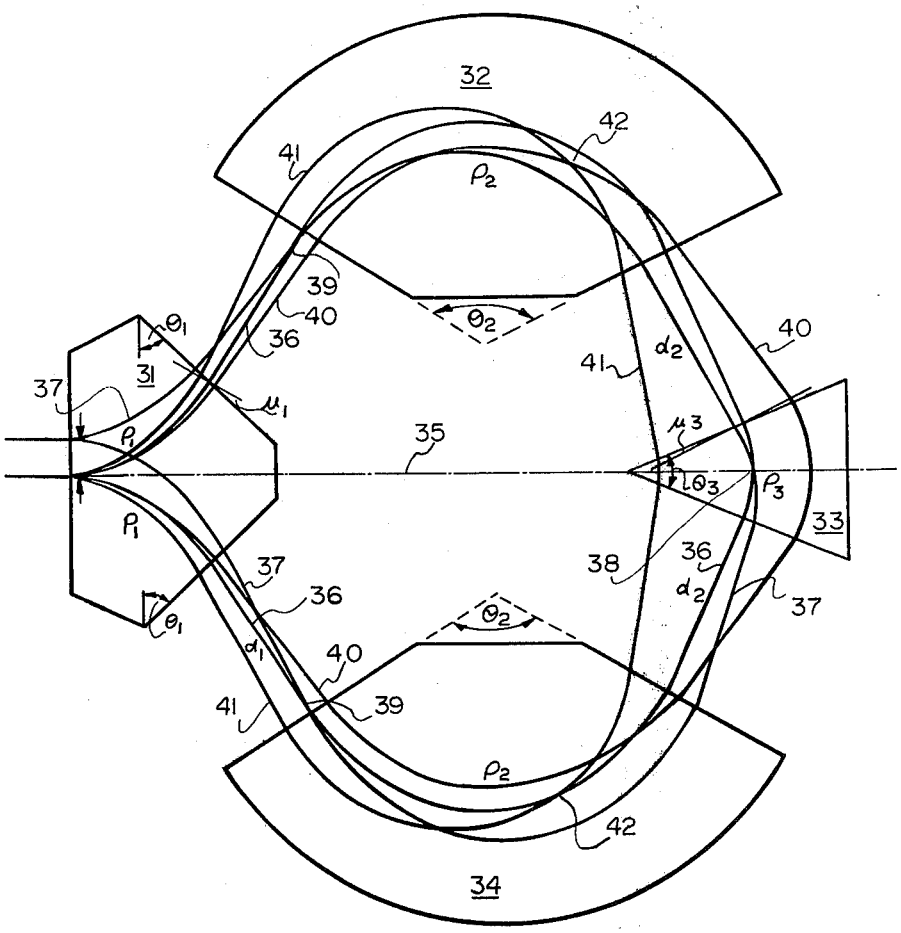
FIG. 3 illustrates one embodiment of the 180° magnetic deflector system.

One embodiment of a magnet system in accordance with this invention for a 13MeV electron beam is illustrated in FIG. 3. It includes four dipole magnets 31, 32, 33 and 34 symmetrically located about a central axis 35. The embodiment has the parameters $\rho_1 = 5.29$ cm., $\rho_2 = 5.88$ cm., $\rho_3 = 2.59$ cm., $\theta_1 = 58.5°$, $\theta_2 = 116.63°$, $d_1 = 5.15$ cm., $d_2 = 6.59$ cm., $\mu_1 = 18.7°$ and $\mu_2 = 13.5°$.

The correction angles for $\mu_1$ and $\mu_2$, namely $\psi_1$ and $\psi_2$ are 6.7° and 11.7° respectively.

This system provides a net bending angle of 180° with coincident beam entry and exit axes, as shown for zeroth order particles 36. Particles 37 which are displaced in the radial plane by up to 1 cm., cross the mid-plane 35 at a radial focus 38, with second symmetrical radial foci existing at 39, whereas particles displaced in the axial plane (not shown) cross the mid-plane perpendicular thereto. This insures that the beam size at exit is the same as at the entry. To ensure double achromatism, particles relativistic in velocity with a momentum displacement, all cross the mid-plane perpendicularly. In FIG. 3, particles 40 have a +10% momentum displacement and particles 41 have a −10% momentum displacement. Finally, the system provides momentum foci 42 symmetrically located about the mid-plane such that the path lengths of particles of differing momenta are identical.

Figure 4:
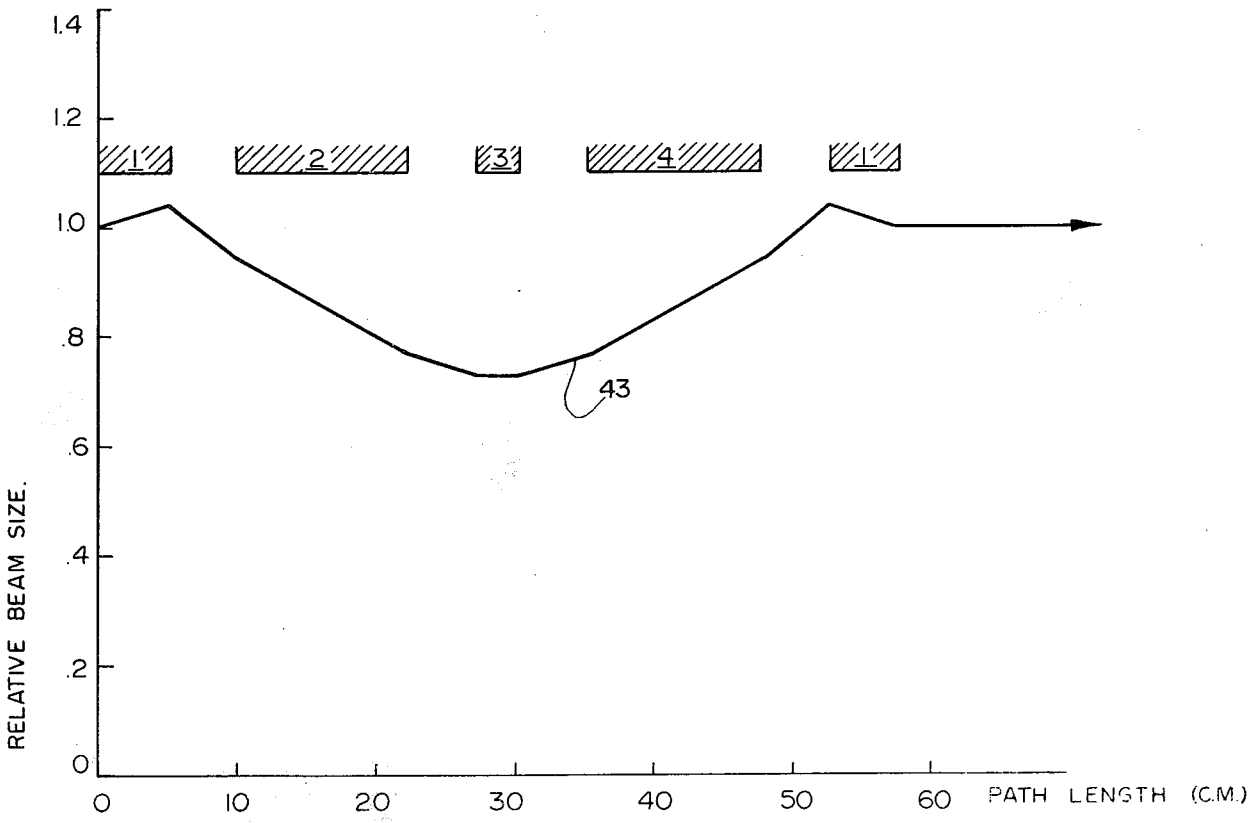
FIG. 4 illustrates the beam profile in the axial plane FIG. 3.

Beam optics in the axial plane are shown in FIG. 4 where the predefined symmetry is clearly seen giving one to one imaging for paraxial beam 4.

Although these specific values of the system parameters have been used, the invention is not limited to this case. Neither is the invention limited to four simple dipoles, nor to a net bending angle of 180°. Any magnetic field configuration formed in any way that meets simultaneously all the symmetry relations outlined above will be an achromatic isochronous non-focussing deflector. In general there will be second order abberations of the system and without altering the first order solution these can be minimized by the addition of pole face curvature to the pole edges.

I claim:

1. A magnetic deflector system for deflecting a particle beam through 180° and having coincident beam entry and axis comprising:

first dipole magnet means having an edge perpendicular to said entry axis to receive said beam and positioned symmetrically about a symmetry plane through said entry axis, said first magnet means adapted to deflect said beam away from said symmetry plane through an angle $\theta_1$ with a bending radius $\rho_1$;

second dipole magnet means positioned to one side of said symmetry plane at a distance $d_1$ from said first magnet means and adapted to deflect said beam toward said symmetry plane through an angle $\theta_2$ with a bending radius $\rho_2$;

third dipole magnet means positioned symmetrically about said symmetry plane at a distance $d_2$ from said second magnet means and adapted to deflect said beam through said symmetry plane through an angle $\theta_3$ with a bending radius $\rho_3$;

fourth dipole magnet means positioned to the other side of said symmetry plane symmetrically with said second magnet means at a distance $d_1$ and $d_2$ from said third magnet means and said first magnet means respectively and adapted to deflect the beam through an angle $\theta_2$ with a bending radius $\rho_2$ to said first magnet means;

said first magnet further adapted to deflect the beam received from said fourth magnet means through an angle $\theta_1$ with a bending radius $\rho_1$ to eject the beam along the exit axis;

the zeroth order beam path through said magnet means being defined by:

$$\theta_2 = \theta_1 + \theta_3 + 90° \text{ and}$$

$$d_2 = \frac{\{d_1 \sin\theta_1 + \rho_1 (1-\cos\theta_1) - \rho_3 |\sin\theta_3| - \rho_2(\cos\theta_1 + \sin\theta_3)\}}{\cos\theta_3}.$$

2. A magnetic deflector system as claimed in claim 1 wherein particles in the beam displaced from the entry axis in the symmetry plane are deflected to cross the symmetry plane perpendicular thereto in the third magnet means.

3. A magnetic deflector system as claimed in claim 2 wherein particles displaced from the entry axis perpendicular to the symmetry plane are deflected to cross the symmetry plane at a focus point in the third magnet means.

4. A magnetic deflector system as claimed in claim 1 wherein beam particles of differing momenta are all deflected to cross the symmetry plane perpendicular thereto in said third magnet means.

5. A magnet deflector system as claimed in claim 4 wherein all particles are deflected to provide equal rates of passage through said deflector system.

6. A magnet deflector system as claimed in claim 5 wherein all particles relativistic in velocity are deflected through two momentum foci symmetrically located about the symmetry plane.

* * * * *